US010900475B2

(12) United States Patent
Weightman et al.

(10) Patent No.: US 10,900,475 B2
(45) Date of Patent: Jan. 26, 2021

(54) DISTRIBUTION UNIT

(71) Applicant: Halliburton Energy Services, Inc., Houston, TX (US)

(72) Inventors: Glenn Howard Weightman, Duncan, OK (US); Joe A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 16 days.

(21) Appl. No.: 16/333,953

(22) PCT Filed: Oct. 17, 2016

(86) PCT No.: PCT/US2016/057336

§ 371 (c)(1),
(2) Date: Mar. 15, 2019

(87) PCT Pub. No.: WO2018/074995

PCT Pub. Date: Apr. 26, 2018

(65) Prior Publication Data

US 2019/0211814 A1 Jul. 11, 2019

(51) Int. Cl.
*F04B 17/03* (2006.01)
*E21B 41/00* (2006.01)
(Continued)

(52) U.S. Cl.
CPC ..... *F04B 17/03* (2013.01); *E21B 41/00* (2013.01); *E21B 43/25* (2013.01); *E21B 43/26* (2013.01);
(Continued)

(58) Field of Classification Search
CPC .... F04B 17/03; F04B 9/10; F04B 9/12; F04B 23/04; F04B 47/00; F04B 49/065; E21B 41/00; E21B 43/25; E21B 43/26
See application file for complete search history.

(56) References Cited

U.S. PATENT DOCUMENTS 7,525,264 B2 * 4/2009 Dodge ..... H02P 1/54 318/108
7,602,143 B2 * 10/2009 Capizzo ..... B60K 15/063 320/109
(Continued)

OTHER PUBLICATIONS

International Search Report and Written Opinion issued in related PCT Application No. PCT/US2016/057336 dated Jul. 10, 2017, 14 pages.

*Primary Examiner* — Aaron L Lembo
(74) *Attorney, Agent, or Firm* — John W. Wustenberg; Baker Botts L.L.P.

(57) ABSTRACT

In accordance with presently disclosed embodiments, a system and method for distributing electrical or other forms of power, fluids, data, fuel, and combinations thereof for performing hydraulic well stimulation treatments is provided. The disclosed distribution unit may include an arrangement of distribution lines (e.g., cables or fluid conduits) disposed within a body of the distribution unit for routing various resources between connection points used to connect the distribution unit to nearby stimulation equipment. The manifolded distribution unit provides convenient and efficient routing of power, fuel, data, and other items needed by equipment disposed about a well site.

15 Claims, 4 Drawing Sheets

(51) Int. Cl.

| | |
|---|---|
| ***E21B 43/26*** | (2006.01) |
| ***F04B 9/10*** | (2006.01) |
| ***F04B 9/12*** | (2006.01) |
| ***F04B 23/04*** | (2006.01) |
| ***F04B 47/00*** | (2006.01) |
| ***F04B 49/06*** | (2006.01) |
| ***E21B 43/25*** | (2006.01) |

(52) U.S. Cl.
CPC ..... *F04B 9/10* (2013.01); *F04B 9/12* (2013.01); *F04B 23/04* (2013.01); *F04B 47/00* (2013.01); *F04B 49/065* (2013.01)

(56) References Cited

U.S. PATENT DOCUMENTS

| | | | | |
|---|---|---|---|---|
| 7,628,182 | B2 * | 12/2009 | Poulter | B67D 7/36 137/263 |
| 7,717,193 | B2 * | 5/2010 | Egilsson | B66D 1/485 166/77.1 |
| 9,127,545 | B2 * | 9/2015 | Kajaria | E21B 43/26 |
| 9,346,662 | B2 * | 5/2016 | Van Vliet | B67D 7/04 |
| 9,410,410 | B2 * | 8/2016 | Broussard | E21B 43/26 |
| 9,534,473 | B2 * | 1/2017 | Morris | F01D 25/28 |
| 9,634,470 | B2 * | 4/2017 | Kwon | H02G 1/04 |
| 9,797,395 | B2 * | 10/2017 | Urdaneta | F04B 51/00 |
| 9,893,500 | B2 * | 2/2018 | Oehring | E21B 41/00 |
| 10,036,238 | B2 * | 7/2018 | Oehring | E21B 43/26 |
| 10,408,031 | B2 * | 9/2019 | Oehring | E21B 41/0092 |
| 10,494,898 | B2 * | 12/2019 | Kajaria | E21B 17/02 |
| 10,519,730 | B2 * | 12/2019 | Morris | C09K 8/80 |
| 2011/0197988 | A1 | 8/2011 | Van Vliet et al. | |
| 2011/0247825 | A1 | 10/2011 | Batho et al. | |
| 2013/0306322 | A1 * | 11/2013 | Sanborn | E21B 43/26 166/308.1 |
| 2014/0000899 | A1 * | 1/2014 | Nevison | E21B 43/26 166/308.1 |
| 2014/0251623 | A1 * | 9/2014 | Lestz | E21B 43/267 166/308.2 |
| 2016/0032703 | A1 * | 2/2016 | Broussard | E21B 43/26 166/250.01 |
| 2016/0105022 | A1 | 4/2016 | Oehring et al. | |
| 2016/0230525 | A1 * | 8/2016 | Lestz | E21B 43/267 |
| 2016/0251946 | A1 | 9/2016 | Farshori et al. | |
| 2016/0258267 | A1 * | 9/2016 | Payne | E21B 43/26 |
| 2016/0273328 | A1 | 9/2016 | Oehring | |
| 2016/0348479 | A1 * | 12/2016 | Oehring | F01D 15/08 |
| 2016/0369609 | A1 * | 12/2016 | Morris | E21B 43/26 |
| 2017/0030177 | A1 * | 2/2017 | Oehring | E21B 7/02 |
| 2018/0156210 | A1 * | 6/2018 | Oehring | H02P 29/032 |
| 2018/0283151 | A1 * | 10/2018 | Cook | E21B 43/26 |
| 2020/0040878 | A1 * | 2/2020 | Morris | F04B 17/03 |

* cited by examiner

DISTRIBUTION UNIT

CROSS-REFERENCE TO RELATED APPLICATION

The present application is a U.S. National Stage Application of International Application No. PCT/US2016/057336 filed Oct. 17, 2016, which is incorporated herein by reference in its entirety for all purposes.

TECHNICAL FIELD

The present disclosure relates generally to well stimulation operations, and more particularly, to a system and method for distributing power, fuel, communications, and other resources to multiple stimulation equipment units.

BACKGROUND

During the drilling and completion of oil and gas wells, various wellbore treatments are performed on the wells for a number of purposes. For example, hydrocarbon-producing wells are often stimulated by hydraulic fracturing operations, where a servicing fluid such as a fracturing fluid may be introduced into a portion of a subterranean formation penetrated by a wellbore at a hydraulic pressure sufficient to create or enhance fractures therein. Such a fracturing treatment may increase hydrocarbon production from the well.

At a well stimulation site, there are typically several large pieces of stimulation equipment on location that must be powered including, but not limited to, a gel mixer, liquid handling equipment, sand handling equipment, a blender, a plurality of high pressure hydraulic pumping units, and a control center. The equipment on location is used to deliver large quantities of fluid/proppant mixtures to a wellhead at high pressures to perform the desired well stimulation operations.

Often, the hydraulic pumping units and other machinery on location are powered by diesel engines. In general, these diesel engines operate at relatively low efficiencies (e.g., approximately 32%). The well stimulation site will often include several individual diesel powered units (e.g., pumping units, blenders, etc.) that must be refueled multiple times a day throughout a multi-stage stimulation operation. These diesel powered units are often self-contained such that the diesel engine on each unit provides power to all operating systems on that unit.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for distributing electrical or other forms of power, fluids, data, fuel, and combinations thereof for performing well stimulation treatments, such as hydraulic fracturing treatments, well acidizing treatments, and treatments using expanded gases. A standard well stimulation manifold trailer/skid allows for the convenient and efficient distribution of low-pressure and high-pressure treatment fluids. Specifically, such manifolds are used to distribute low pressure treatment fluid from a blender outlet to a plurality of high pressure hydraulic pumps, and high pressure fluid from the hydraulic pumps to a wellhead. The disclosed embodiments are directed to an improved distribution unit that may be used to route other items between multiple equipment units at a well site. For example, the distribution unit may be used to provide resources (e.g., electrical power, non-electrical power, or fuel) used to power hydraulic operations carried out by the stimulation equipment units.

Existing systems generally utilize on-board diesel engines to power the well stimulation operations of individual units and discrete wiring to provide electrical communication between different units. The disclosed manifolded distribution unit provides convenient and efficient routing of power, fuel, data, and other items needed by equipment disposed about a well site. Such distribution units may be particularly useful as electrical and natural gas powering of stimulation equipment becomes further developed. The disclosed distribution unit may be self-contained and able to provide a wide range of items to the various equipment units on location, while reducing rig-up time and providing greater efficiency of shut-down operations.

Figure 1:
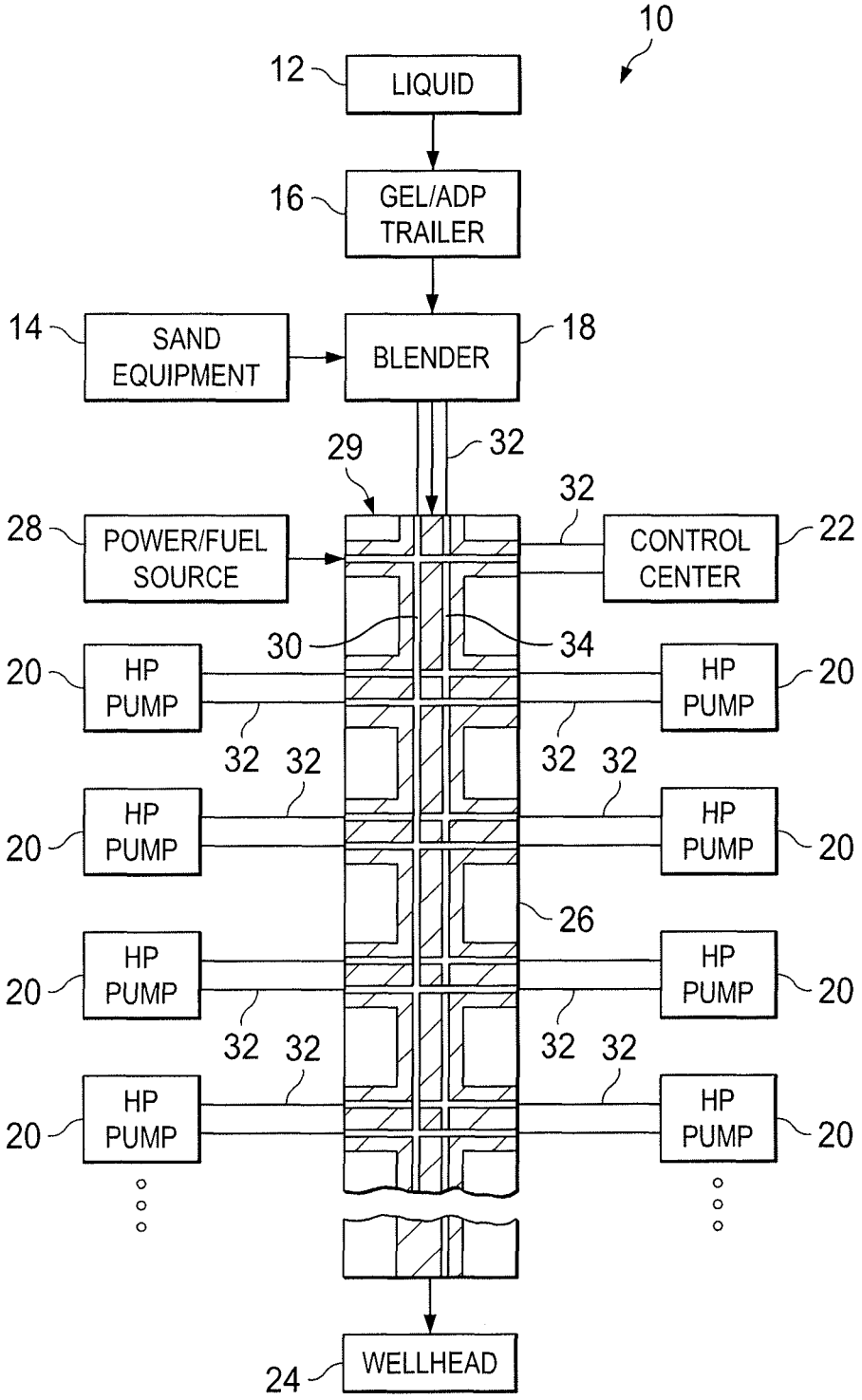
FIG. 1 is a schematic block diagram of a well stimulation spread where a distribution unit may be employed, in accordance with an embodiment of the present disclosure.

Turning now to the drawings, FIG. 1 is a block diagram of a well stimulation equipment spread 10 used in performing stimulation treatments on a well. The stimulation spread 10 may include liquid handling equipment 12, sand handling equipment 14, gel/advanced dry polymer (ADP) handling equipment 16 (e.g., gel/ADP trailer), a blender unit 18, a plurality of high pressure hydraulic pumping units 20, a control center 22, and a wellhead 24. In some embodiments, the spread 10 may not include all of the components illustrated. For example, the spread 10 may not include the illustrated gel/ADP trailer 16 when a gel mixture or ADP mixture is not needed to create a desired treatment fluid. In some embodiments, one or more of the illustrated stimulation equipment components may be separated into two or more separate units. In still other embodiments, two or more of the illustrated stimulation equipment components may be incorporated into a single unit. It should be noted that additional stimulation equipment components not shown in FIG. 1 may be located at the well site as well, and different numbers and arrangement of the illustrated stimulation equipment may be used.

In a general well stimulation operation, the liquid handling equipment 12 may provide water that is entirely made up of potable water, freshwater, and/or treated water for mixing a desired treatment fluid. Other liquid may be provided from the liquid handling equipment 12 as well. The water (or other liquid) may be mixed with a viscosity-increasing agent in the gel/ADP trailer 16 to provide a higher viscosity fluid to help suspend sand or other particulate. The sand handling equipment 14 may output dry bulk material such as sand, proppant, and/or other particulate into the blender unit 18 at a metered rate. The blender unit 18 may mix the sand with the higher-viscosity water-based fluid in a mixing compartment to form a treatment fluid for stimulating the well.

The blender unit 18 may be coupled to an array of high pressure hydraulic pumping units 20. Although only eight high pressure hydraulic pumping units 20 are illustrated, several more pumping units 20 may be positioned on location. The high pressure hydraulic pumping units 20 are arranged in parallel and used to deliver the treatment fluid to the wellhead 24 such that the treatment fluid is pumped into the wellbore at a desired pressure for stimulating the well.

The control center 22 may be communicatively coupled to various sensing and/or control components on the other stimulation equipment. The control center 22 may include data acquisition components and one or more processing components used to interpret sensor feedback and monitor the operational states of the stimulation equipment located at the well site. In some embodiments, the control center 22 may output control signals to one or more actuation components of the stimulation equipment to control the well stimulation operation based on the sensor feedback.

At the spread 10, many of the large stimulation equipment components (e.g., liquid handling unit 12, sand handling equipment 14, gel/ADP trailer 16, blender unit 18, high pressure pumping units 20, and control center 22) must be powered. The power requirements for these components together may be on the order of approximately 30 Megawatts. Some or all of these stimulation equipment components may be self-powered using on-board engines that require frequent refueling. In other embodiments, the stimulation equipment components may receive operating power from an external power generation source. In some embodiments, it may be desirable for the stimulation equipment to be communicatively coupled to each other for exchanging data, control signals, and other electrical signals.

The disclosed embodiments are directed to a distribution unit 26 that is coupled between a plurality of on-site stimulation equipment components to route power, fuel, electrical signals, fluid, and/or other resources to the equipment as needed to perform well stimulation operations. As illustrated, the distribution unit 26 may be coupled to a power and/or fuel source 28 disposed on location. The distribution unit 26 may route power, fuel, or both from the power/fuel source 28 to various stimulation equipment components to provide the power needed to operate the equipment. For example, as illustrated, the distribution unit 26 may include a body 29 and an arrangement 30 of cables or conduits disposed in the body 29 and designed to route power/fuel from the power/fuel source 28 to various components (e.g., blender 18, high pressure pumping units 20, and control center 22) coupled to the distribution unit 26. The distribution unit 26 may be coupled to these stimulation equipment units at dedicated connection points 32 disposed along the distribution unit 26.

The power/fuel source 28 may be an electrical power generation system (e.g., turbine generator, fuel cell-based system, diesel engine powered generator, natural gas engine powered generator, generator powered by one or more tractors, generator on a nearby mobile stimulation equipment unit, or a conventional grid) designed to output electrical AC or DC power for distribution to multiple stimulation equipment units. In other embodiments, the power/fuel source 28 may be a non-electrical (e.g., steam, hydraulic, pneumatic) power source designed to output non-electrical power for distribution. In embodiments where the stimulation equipment units coupled to the distribution unit 26 have their own on-board engines, the fuel/power source 28 may be a fuel source used to output fuel (e.g., natural gas, diesel, etc.) for distribution to the engines on the equipment units.

The distribution unit 26 may route other resources or items between on-site stimulation equipment. For example, the distribution unit 26 may route data/control communications between different pieces of equipment (e.g., pumps 20 and control center 22) on location. The distribution unit 26 may include electrical bonding lines, as described below. In the illustrated embodiment, the distribution unit 26 may also include a fluid manifold 34 used to distribute low-pressure and high pressure treatment fluids between the stimulation equipment. The blender unit 18 may be coupled to the high pressure hydraulic pumping units 20 via the manifold 34 on the distribution unit 26 to provide treatment fluid to the wellhead at a desired pressure for the well stimulation operation. However, it should be noted that in other embodiments the blender unit 18 may be coupled to the high pressure pumps 20 and the wellhead 24 via a fluid manifold that is separate from the disclosed distribution unit 26. That is, the distribution unit 26 should not be limited to including a treatment fluid manifold.

The distribution unit 26 may distribute the desired resources to any stimulation equipment that is within reach of the connecting points 32 on the distribution unit 26. The distribution unit 26 may be designed with multiple arrangement of cables, conduits, and manifolds to distribute various resources to whichever stimulation equipment units will use them. As illustrated, the distribution unit 26 may provide distribution of resources lengthwise down the full length of the distribution unit 26, from side to side across the distribution unit 26, or both.

Figure 2:
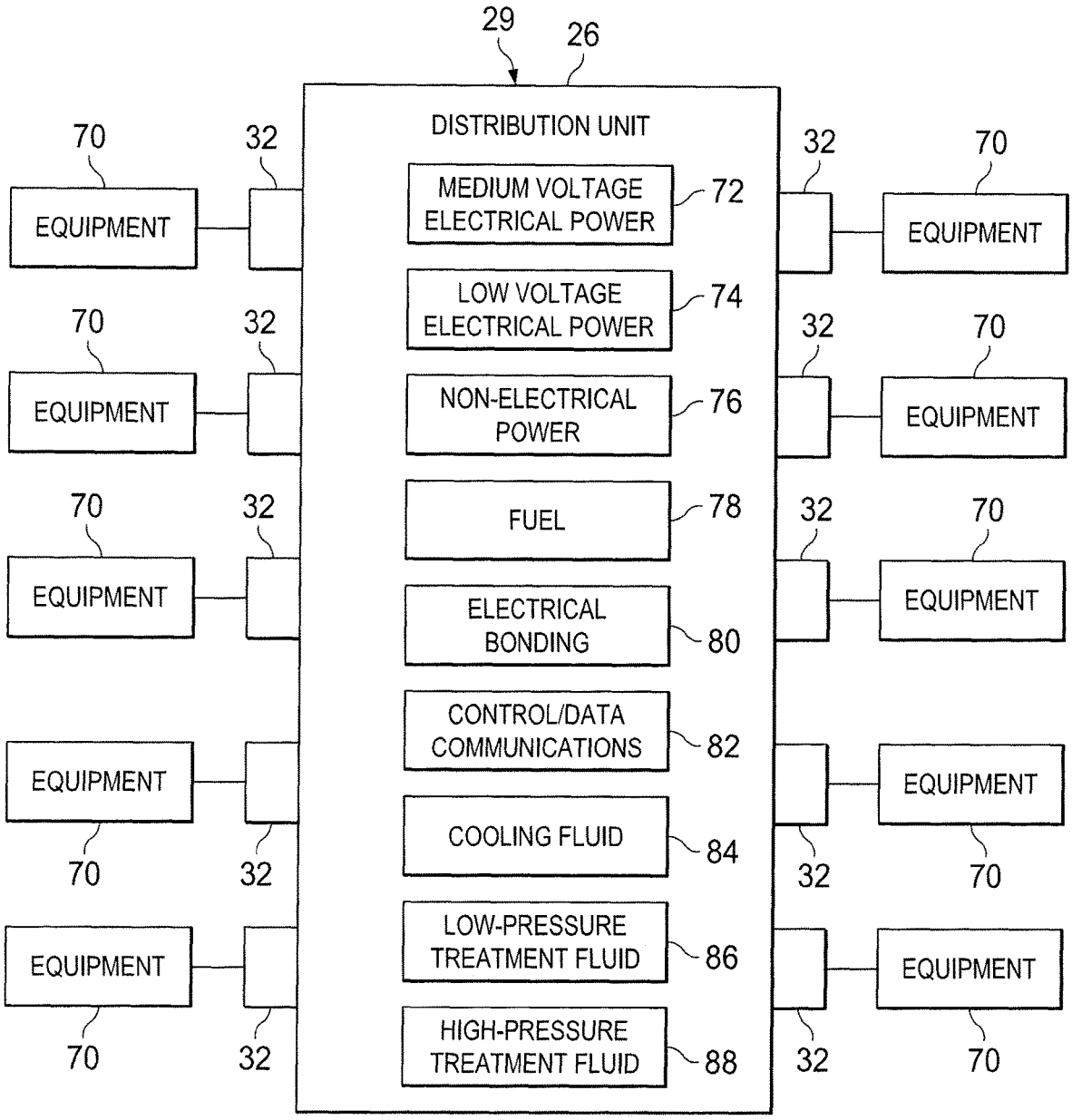
FIG. 2 is a schematic block diagram illustrating the various power, fuel, and other resources that may be distributed to stimulation equipment using a distribution unit, in accordance with an embodiment of the present disclosure.

As described above, the distribution unit 26 may be used to route various resources and items between multiple stimulation equipment units (e.g., blender 18, pumps 20, control center 22, power/fuel source 28, sand handling unit 14, liquid handling unit 12, gel/ADP trailer 16, etc.) on location. FIG. 2 schematically illustrates a distribution unit 26 that can be used to route a variety of different resources to multiple stimulation equipment units 70. These resources may include, for example, medium voltage electrical power 72, low voltage electrical power 74, non-electrical power 76, fuel 78, electrical bonding 80, control/data communications 82, cooling fluid 84, low-pressure treatment fluid 86, high-pressure treatment fluid 88, or a combination thereof. The distribution unit 26 may be designed with arrangements of distribution lines (in the form of cables or fluid conduits) for communicating any desired type, number, or combination of the resources listed.

The body 29 of the distribution unit 26 may be constructed in the form of a trailer, multiple trailers connected together, a skid, multiple skids connected together, a self-powered truck (or trucks connected together), a permanent or semi-permanent structure, a modular arrangement, or a combination thereof. The term modular arrangement refers to the use of a series of frames (each having parts of the distribution manifold fabricated therein) locked together in a desired arrangement. The distribution unit 26 is designed specifically for the equipment components 70 that will be connected to the distribution unit 26, since these components 70 may have specific distribution needs and connection interfaces.

The distribution unit 26 may be used to distribute electrical power to one or more of the equipment units 70 coupled thereto. To that end, the distribution unit 26 may include one or more electrical power distribution lines for distributing power. The distributed electrical power may be AC or DC and of any desired voltage and current rating. The electrical distribution lines may include multiple AC phases (typically three), DC lines, one or more power grounds, one or more neutral lines, and/or electromagnetic shielding. In some embodiments, the distribution unit 26 may be used to distribute medium voltage electrical power 72 (e.g., 4160 VAC) for operating main loads (e.g., motors) on the equipment units 70. Additionally or alternatively, the distribution unit 26 may distribute low voltage electrical power 74 (e.g., 480 VAC) for operating auxiliary loads such as blowers, cooling pumps, pump or engine warmers, or equipment for generator "black starts".

The distribution unit 26 may be used to distribute non-electrical power 76 to one or more of the equipment units 70. The distribution unit 26 may include power distribution lines or manifolding for providing non-electrical power 76 in the form of steam, hydraulic fluid, or airflow (e.g., from an off-shore pneumatic valve) to operate various components on the attached stimulation equipment units 70. The non-electrical power 76 may be used in place of electrical power for operating the main loads on the equipment 70. In other embodiments, the non-electrical power 76 may be used for other auxiliary power requirements (e.g., cooling fans, etc.) in addition to electrical power 72 that is separately distributed to operate the main loads on the equipment 70.

The distribution unit 26 may be used to distribute fuel 78 to power on-board engines or electrical generators on one or more of the attached equipment units 70. The distribution unit 26 may include one or more fuel lines, which may be used to distribute fuel 78 such as natural gas, diesel, gasoline, propane, or another suitable fuel for powering components on the equipment units 70. By distributing fuel 78 to a plurality of equipment units 70 on location, the distribution unit 26 may eliminate the need for individual fuel tanks on the stimulation equipment units 70. This would reduce the weight and space requirements of the equipment units 70. In addition, routing the fuel 78 through the distribution unit 26 may enable a single shut-off valve to be used for cutting off the fuel supply to the equipment units 70 in response to an adverse event.

The distribution unit 26 may be used to provide electrical bonding 80 for one or more of the attached stimulation equipment units 70. Specifically, the distribution unit 26 may include one or more protective ground/earth/bonding distribution lines coupled to one or more pieces of equipment 70 on location. The distribution unit 26 may provide a common bond line for multiple equipment units 70 that utilize AC power components. The bonding distribution line may provide a low impedance path for a fault current flowing through one of the connected stimulation equipment units 70.

The distribution unit 26 may be used to provide control/data communications 82 between different equipment units 70 that are connected to the distribution unit 26. The distribution unit 26 may include one or more data or control lines for providing communications 82 between different on-site components. These data/control communications 82 may include, for example, network communications, process control signals, power management signals (including generator synchronization), among others. The distribution unit 26 may provide a self-contained and centralized communications network between various on-site equipment units 70, as opposed to using large numbers of discrete wired connections disposed around the worksite.

The distribution unit 26 may be used to deliver cooling fluid 84 to one or more of the attached stimulation equipment units 70. The distribution unit 26 may include an arrangements of conduits (or manifolding) to direct the cooling fluid 84 into individual cooling sections (e.g., radiators) of equipment units 70 that are connected to the distribution unit 26. The cooling fluid 84 may be pumped into the distribution unit 26 from a separate cooling unit (not shown). By routing cooling fluid 84 through the distribution unit 26, the system may enable the use of just one or two centralized fluid cooling units on location to provide the fluid for cooling multiple equipment units 70.

The distribution unit 26 may also include one or more manifolds for delivering low-pressure treatment fluid 86 and/or high pressure treatment fluid 88 between the equipment units 70 on location. As described above, for example, the distribution unit 26 may include an arrangement of fluid conduits for routing low-pressure fluid 86 pumped from a blender unit to multiple high pressure hydraulic pumping units and for routing high-pressure fluid 88 from the pump units to the wellhead. In some embodiments, the distribution unit 26 may be used to route this treatment fluid 86/88 between the equipment units 70 in addition to routing power or fuel, data communications, and other resources to the equipment units 70.

In some embodiments, the distribution unit 26 may include a protective structure for protecting the one or more distribution lines disposed throughout the distribution unit 26. This protective structure may be in the form of a conduit, a cable try, ductwork, or some other structure. In other embodiments, the distribution unit 26 may include distribution lines that are exposed, such as all-weather cables.

Figure 3:
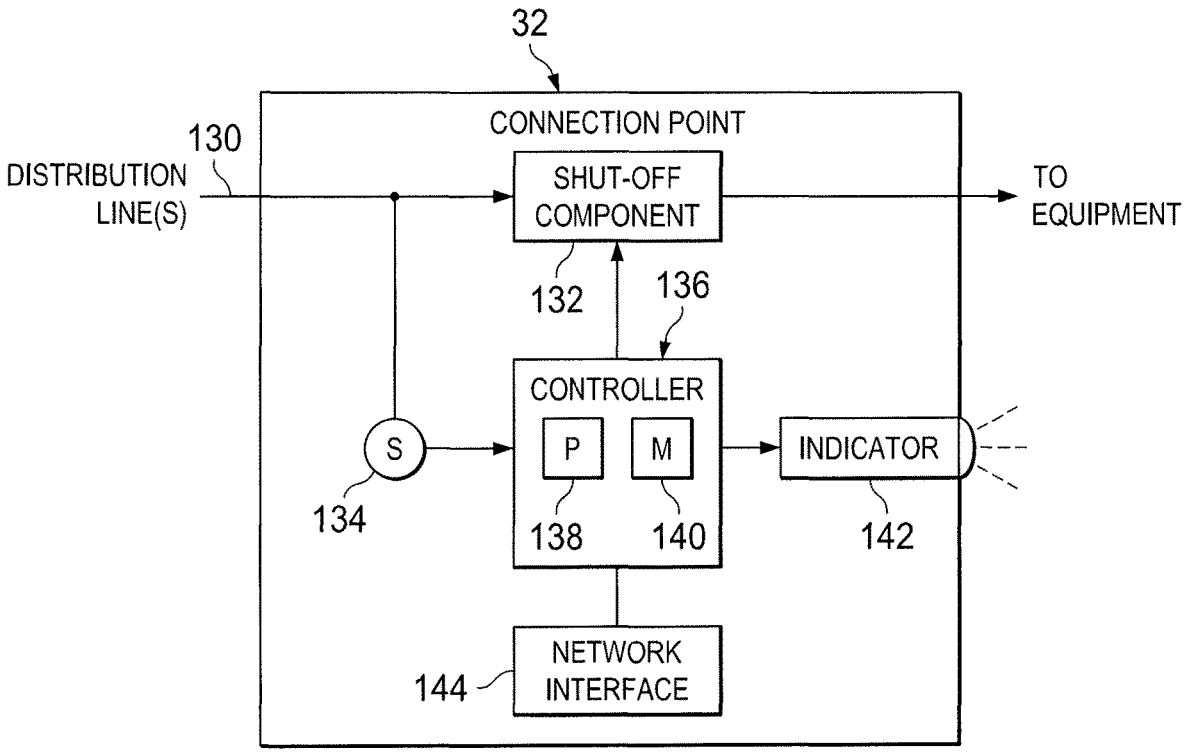
FIG. 3 is a schematic block diagram of a connection point for coupling a distribution unit to a stimulation equipment unit, in accordance with an embodiment of the present disclosure.

As illustrated in FIGS. 1 and 2, the distribution unit 26 may include multiple taps or connection points 32 for distributing items to the multiple equipment units 70 on location. FIG. 3 schematically illustrates an embodiment of one such connection point 32 used to connect a piece of stimulation equipment 70 to the distribution unit 26. As shown, one or more distribution lines 130 of the distribution unit 26 may deliver resources (e.g., power, fuel, communications, fluid, etc.) to one end of the connection point 32. At the other end, the connection point 32 may include one or more fittings or electrical connectors for delivering the resources from the distribution lines 130 to the equipment unit 70 coupled to the connection point 32. In general, the equipment unit 70 may be removably coupled to the distribution unit 26 at the connection point 32. In some embodiments, the connection points 32 may be quick connects for selectively attaching to desired equipment 70. In other embodiments, the connection points 32 may be more permanent connections.

As illustrated, the connection point 32 may include a shut-off component 132 for each distribution line 130. The shut-off component 132 may include a valve when used on distribution lines that deliver fuel, hydraulic fluid, cooling liquid, steam, and other fluids to the connected equipment 70. The shut-off component 132 may include an electrical disconnect (e.g., switch, relay) when used on electrical distribution lines that deliver electrical power or communications to the equipment 70. Other types of shut-off components 132 may be used in other embodiments as well. The operation of the shut-off component 132 may be manual, automatic, or remotely controlled.

In some embodiments, the connection point 32 may include hardware designed to interrupt the flow or distribution of an item if an abnormal condition is found to exist. For example, the connection point 32 may include a sensor 134 coupled to the distribution line 130 to detect a condition (e.g., current, pressure, etc.) of the distributed resource moving through the line 130. The sensor 134 may be communicatively coupled to a controller 136, as shown. The controller 136 utilizes at least a processor component 138 and a memory component 140 to monitor and/or control various operations at the connection point 32 and/or the well site. For example, one or more processor components 138 may be designed to execute instructions encoded into the one or more memory components 140.

Upon executing these instructions, the processors 138 may output control signals to the shut-off component 132 to interrupt flow/distribution upon detecting an abnormal condition in the distribution line 130 based on feedback from the sensor 134. The processor 138 may output a control signal to shut off flow through the distribution line 130 upon detecting a leak, ground current, phase imbalance, or the like. For example, the controller 136 may receive sensor signals indicating the occurrence of a fault situation, and the controller 136 may shut down the particular branch of the distribution line (or the entire distribution unit) by switching one or more relays. In some embodiments, the processors 138 may provide passive logging of the operational state of electrical power, communications, fluid, or other resources flowing through the distribution lines 130. The processors 138 may monitor the status (quality) of the connection based on sensor feedback, and the processor 138 may provide a local status indication 142 (e.g., light) to inform operators on location of the status at that connection point 32. In some embodiments, the controller 136 may communicate sensed information (e.g., regarding the condition of the distribution line 130 and/or status of the connection point 32) to a remote monitoring location via a network interface 144.

Figure 4:
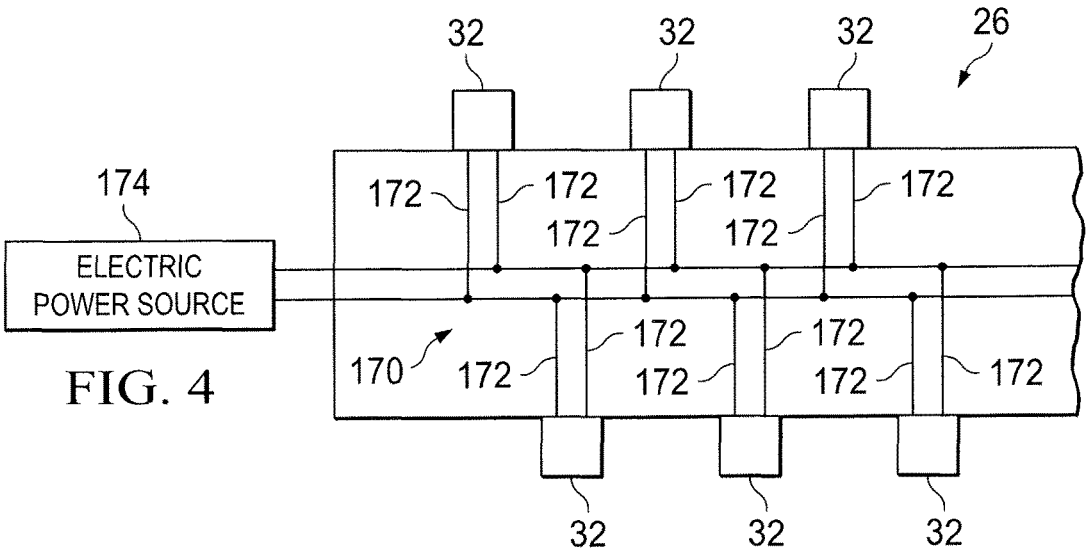
FIG. 4 is a schematic block diagram of a distribution unit that delivers electrical power via a common bus, in accordance with an embodiment of the present disclosure.

As described above, some embodiments of the distribution unit 26 may include electrical distribution lines disposed thereon for providing electrical power to the connected stimulation equipment units 70. The electrical distribution lines may branch off to multiple pieces of stimulation equipment 70 coupled to the distribution unit 26. In some embodiments, as schematically illustrated in FIG. 4, the distribution unit 26 may include a common bus bar 170 with a number of branches 172 extending from the bus bar 170 in parallel. An electrical power source 174 may provide electrical power across the bus bar 170, and the parallel branches 172 may distribute the electrical power to the individual connection points 32 (and connected equipment).

Figure 5:
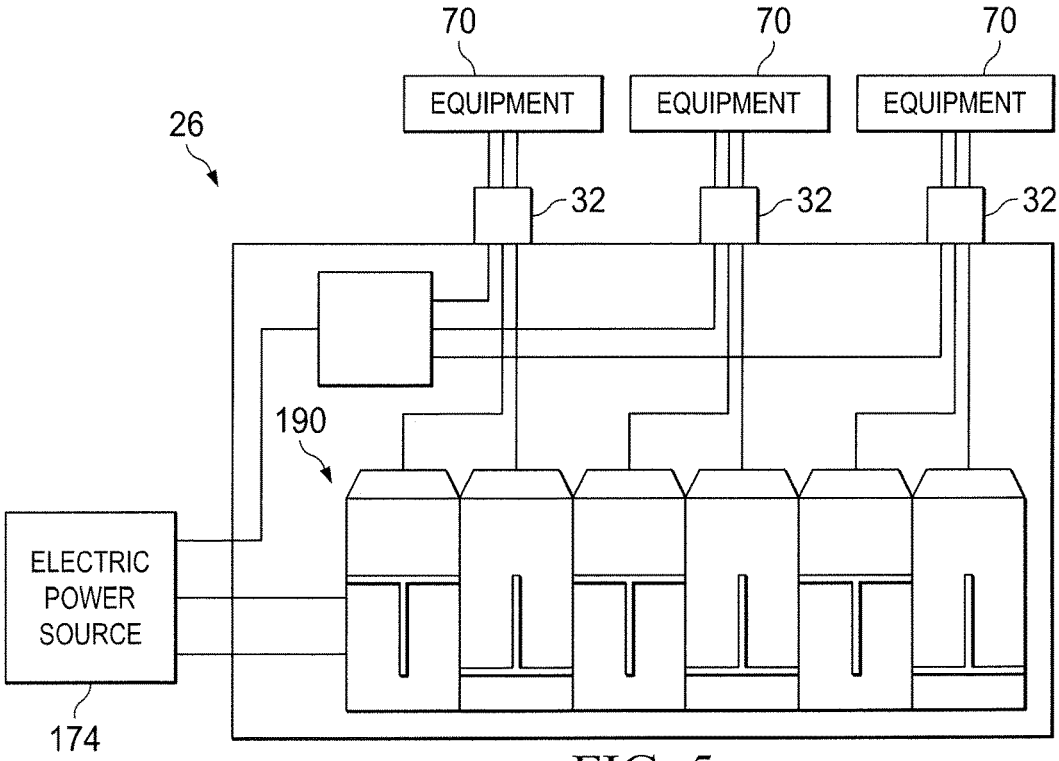
FIG. 5 is a schematic block diagram of a distribution unit that delivers electrical power via a breaker box arrangement, in accordance with an embodiment of the present disclosure.

In other embodiments, as schematically illustrated in FIG. 5, each equipment unit 70 may include its own electrical circuit, and the distribution unit 26 is generally designed as a breaker box 190 for directing power flow to the different equipment units 70. That is, the distribution unit 26 may selectively couple the separate electrical circuits of the attached equipment units 70 to the electrical distribution lines entering the distribution unit 26 from the electrical power source 174. Other types of electrical distribution line arrangements may be utilized in other embodiments of the distribution unit 26. In some embodiments, electrical lines within the distribution unit 26 or at the connection points 32 may be inductively coupled.

Figure 6:
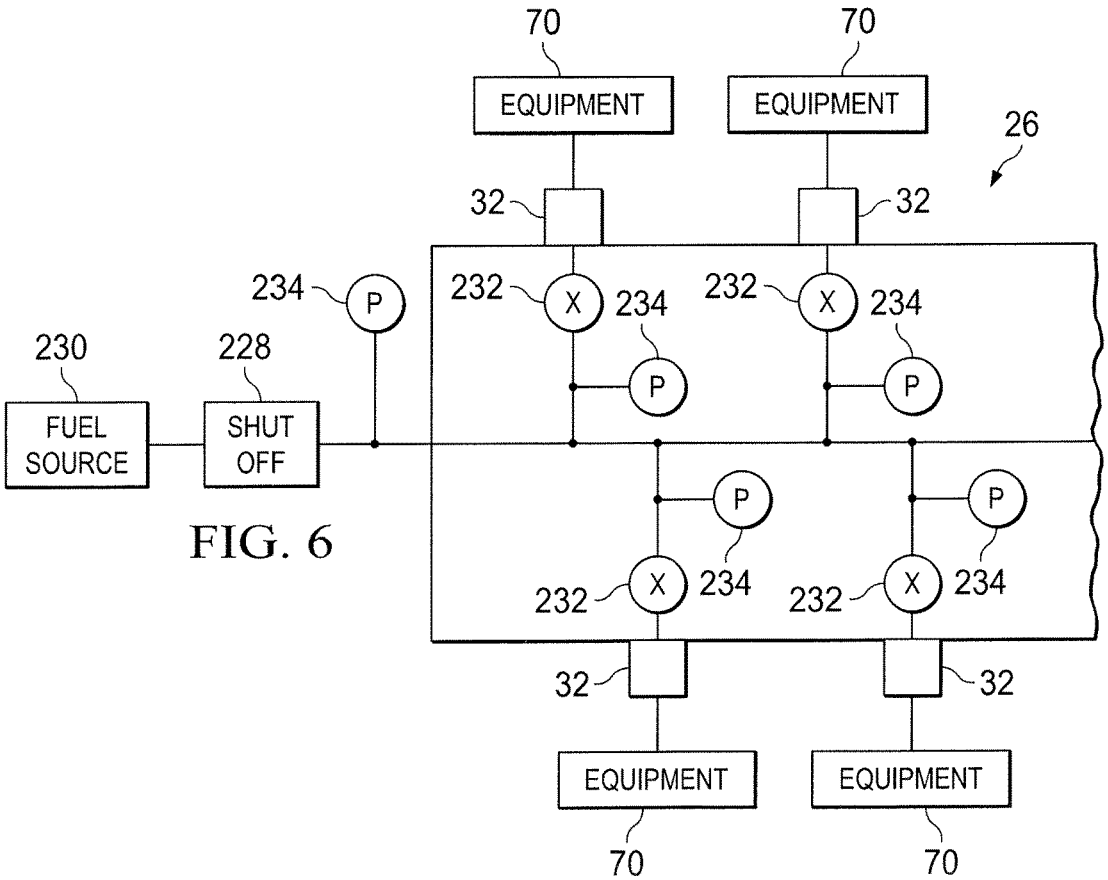
FIG. 6 is a schematic block diagram of a distribution unit that delivers fuel to multiple stimulation equipment units, in accordance with an embodiment of the present disclosure.

FIG. 6 illustrates an embodiment of the distribution unit 26 that may include an arrangement of fuel distribution lines 226 for delivering fuel to multiple equipment units 70 coupled to the distribution unit 26. A similar arrangement of distribution lines may be used to deliver other resources (e.g., steam, hydraulic fluid, treatment fluid, or air) through the distribution unit 26. The distribution lines 226 may include lengths of jointed pipe with cross connectors at desired intervals to route fuel to the connection points 32. As shown, a single fuel shut-off valve 228 may be disposed between a fuel source 230 and the distribution lines 226. Fuel shut-off valves 232 may also be positioned at each branch coming off the main fuel distribution line 226. Pressure sensors 234 may be used throughout the distribution unit 26 to determine if a leak is present in the distribution lines 226. Branch-specific shut-off valves 232 may be closed in response to a loss of pressure in the particular branch of the distribution unit 26. The system-wide shut-off valve 228 may be closed to stop the flow of fuel to all equipment components 70 on location as desired for reasons such as an adverse event on location or pressure loss through the main fuel distribution line 226.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a power source;

a distribution unit coupled to the power source, the distribution unit comprising:

a body;

a plurality of connecting points disposed along the body for coupling the distribution unit to a plurality of stimulation equipment units; and an arrangement of cables or conduits disposed through the body between the power source and the plurality of connecting points to deliver power from the power source to the plurality of stimulation equipment units; and a manifold of fluid lines disposed through the body for delivering treatment fluid between the plurality of stimulation equipment units, wherein a portion of the fluid lines are configured to distribute low pressure treatment fluids and a remaining portion of the fluid lines are configured to distribute high pressure treatment fluids.

2. The system of claim 1, wherein the power source comprises an electrical power source, wherein there are electrical distribution lines disposed between the plurality of stimulation equipment units and the plurality of connecting points of the distribution unit and between the electrical power source and the distribution unit.

3. The system of claim 2, wherein the electrical distribution lines comprise a common bus disposed along a length of the body and parallel electrical lines coupling the common bus to the plurality of connecting points.

4. The system of claim 2, wherein each of the plurality of stimulation equipment units comprises a separate electrical circuit, and wherein the distribution unit selectively couples the separate electrical circuits to the electrical distribution lines.

5. The system of claim 1, wherein the power source comprises a steam, hydraulic, or pneumatic power source, and wherein the distribution unit comprises an arrangement of conduits to deliver steam, hydraulic fluid, or airflow to the stimulation equipment units.

6. The system of claim 1, further comprising a fuel source coupled to the distribution unit, wherein the distribution unit comprises an arrangement of fuel lines disposed between the fuel source and the plurality of connecting points.

7. The system of claim 1, wherein the distribution unit further comprises an arrangement of data lines, control lines, or both for communicating signals between the plurality of stimulation equipment units.

8. The system of claim 1, wherein the distribution unit further comprises one or more bonding lines coupled to the plurality of stimulation equipment units at the connecting points.

9. The system of claim 1, wherein the distribution unit comprises a protective structure disposed around the cables or conduits.

10. The system of claim 1, wherein each of the plurality of connecting points comprises a shut off component for selectively suspending delivery of power from the power source to the corresponding stimulation equipment unit.

11. The system of claim 1, wherein the plurality of stimulation equipment units comprise a unit selected from the group consisting of: a high pressure hydraulic pumping unit, a blender unit, a gel/advanced dry polymer (ADP) mixer, a sand handling unit, and a control center.

12. The system of claim 1, wherein the body is selected from the group consisting of: one or more trailers, one or more skids, a self-powered truck, a permanent or semi-permanent structure, and a modular structure.

13. A method, comprising:

coupling a distribution unit to a plurality of stimulation equipment units;

distributing electrical power from an electrical power source to the plurality of stimulation equipment units via an arrangement of distribution lines disposed between the plurality of stimulation equipment units and a plurality of connecting points of the distribution unit and between the electrical power source and the distribution unit;

powering each of the plurality of stimulation equipment units via the electrical power received from the distribution unit; and distributing treatment fluid to the plurality of stimulation equipment units via a manifold of fluid lines disposed through the distribution unit, wherein a portion of the fluid lines are configured to distribute low pressure treatment fluids and a remaining portion of the fluid lines are configured to distribute high pressure treatment fluids.

14. The method of claim 13, further comprising distributing electrical power from a power source to the plurality of stimulation equipment units, and powering an auxiliary system on each of the plurality of stimulation equipment units via the electrical power.

15. The method of claim 13, further comprising detecting an abnormal condition of the flow of power through the distribution unit, and shutting off the flow of power to at least one of the plurality of stimulation equipment units based on the abnormal condition.

* * * * *